US007015860B2

(12) United States Patent
Alsliety

(10) Patent No.: US 7,015,860 B2
(45) Date of Patent: Mar. 21, 2006

(54) MICROSTRIP YAGI-UDA ANTENNA

(75) Inventor: Mazen K. Alsliety, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/083,718

(22) Filed: Feb. 26, 2002

(65) Prior Publication Data

US 2003/0160730 A1 Aug. 28, 2003

(51) Int. Cl.
*H01Q 1/38* (2006.01)

(52) U.S. Cl. ..... 343/700 MS; 343/815

(58) Field of Classification Search ..... 343/700 MS, 343/815, 792.5, 793, 795, 818, 803, 819
See application file for complete search history.

(56) References Cited

U.S. PATENT DOCUMENTS 4,812,855 A * 3/1989 Coe et al. ..... 343/818
5,220,335 A * 6/1993 Huang ..... 343/700 MS
6,326,922 B1 * 12/2001 Hegendoerfer ..... 343/700 MS
6,483,476 B1 * 11/2002 Cox ..... 343/815

* cited by examiner

*Primary Examiner*—Shih-Chao Chen
(74) *Attorney, Agent, or Firm*—Cardinal Law Group

(57) ABSTRACT

A compact microstrip antenna having elements comprising a Yagi-Uda array is provided for use in an apparatus communicating through the antenna. The microstrip Yagi-Uda antenna is adapted for use in an apparatus such as a cellular phone, PDA, laptop computer, or a vehicle having a telematices device.

24 Claims, 2 Drawing Sheets

MICROSTRIP YAGI-UDA ANTENNA

TECHNICAL FIELD OF THE INVENTION

This invention relates to an apparatus communicating wirelessly through an antenna, and more particularly to an antenna for use with wireless communication devices.

BACKGROUND OF THE INVENTION

Many types of portable electronic devices, such as PCS or cellular phones, palm electronic devices, pagers, laptop computers, and telematics units in vehicles, need an effective and efficient antenna for communicating wirelessly with other fixed or mobile communication units. The antennas used in portable electronic devices present special design challenges in that they must be small in physical size and weight, producible at low cost, and yet powerful, efficient and highly reliable. What is needed is an improved antenna.

SUMMARY OF THE INVENTION

The invention provides an improved antenna by combining an antenna constructed according to both the Yagi-Uda array concept, and the microstrip radiator technique, to provide a Yagi-Uda antenna array in a microstrip antenna. The resulting structure is readily adaptable for use with a variety of electronic devices.

In one form of the invention, an antenna includes a substrate of dielectric material defining a longitudinal axis of the substrate and a surface of the substrate. A plurality of electrically conductive elements are disposed on the surface of the substrate to form a Yagi-Uda dipole array. The Yagi-Uda dipole array may include a driven element and one or more parasitic elements, with electromagnetic energy being coupled from the driven element to the parasitic element through space and by surface waves in the substrate. Because energy is coupled through both the substrate and through space, an antenna according to my invention is more efficient than prior antennas relying solely on coupling the signal through space.

My invention may also take the form of an apparatus having an antenna support and an antenna mounted on the antenna support, where the antenna includes a substrate of dielectric material defining a longitudinal axis of the substrate and a surface of the substrate, and a plurality of electrically conductive elements disposed on the surface of the substrate to form a Yagi-Uda dipole array.

The foregoing and other features and advantages of my invention are apparent from the following detailed description of exemplary embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
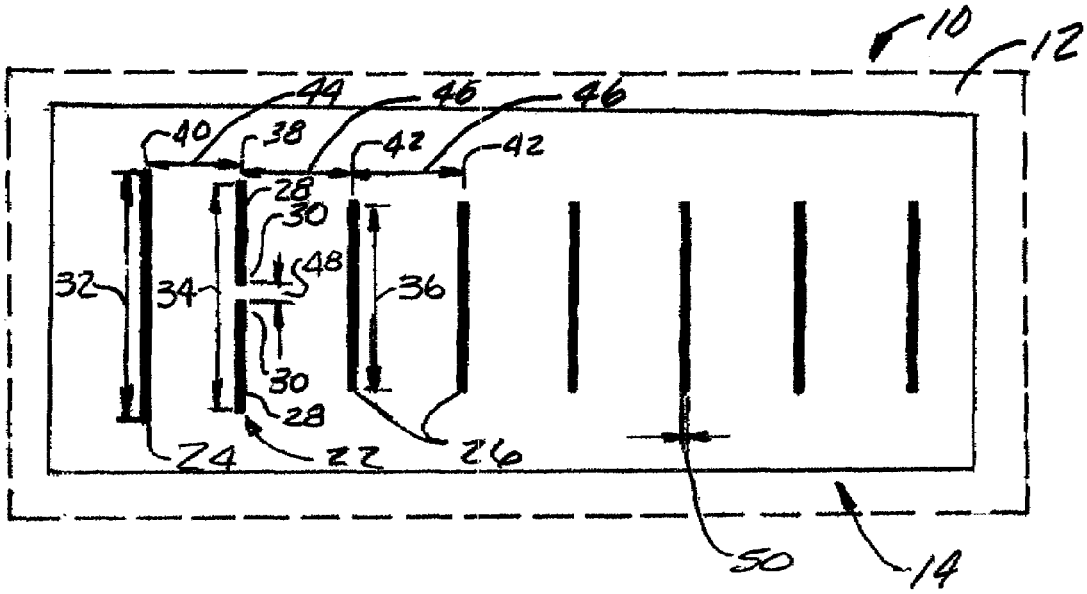
FIG. 1 is a schematic representation of an exemplary embodiment of an apparatus including an antenna according to my invention.
Figure 2:
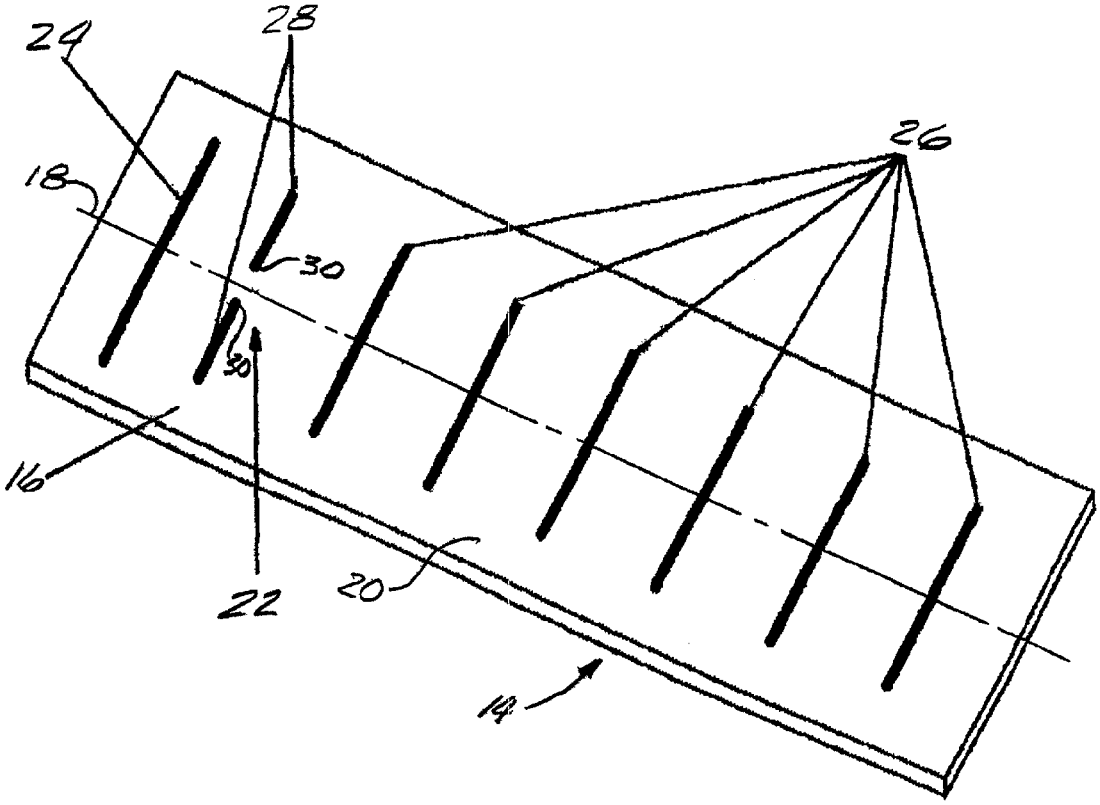
FIG. 2 is a perspective view of an exemplary embodiment of an antenna according to my invention.

FIG. 1 depicts an exemplary embodiment of an apparatus 10, according to the invention, having an antenna support 12 and an antenna 14 mounted on the antenna support 12. As shown in FIG. 2, the antenna 14 includes a substrate 16 of dielectric material defining a longitudinal axis 18 of the substrate 16, and a surface 20 of the substrate 16, and a plurality of electrically conductive elements 22, 24, 26 disposed on the surface 20 of the substrate 16 to form a Yagi-Uda dipole array.

The Yagi-Uda dipole array of the antenna 12 includes a driven element, in the form of a dipole 22, and one or more parasitic elements, in the form of a reflector 24 and six directors 26. Electromagnetic energy is coupled from the driven element 22 to the parasitic elements 24, 26 through space and by surface waves in the substrate 16.

The antenna 14 can be constructed in a wide variety of forms and by many methods. In one embodiment, the antenna 14 is formed of thin, 2 to 5 mil thick, copper elements 22, 24, 26 attached to the surface 20 of a substrate 16 made of either rigid or flexible dielectric material of the type commonly used for forming rigid or flexible electrical circuit boards, and prior microstrip antennas. I contemplate, for example, that a substrate 16 of flexible material having a thickness of about 5 mils to 30 mils may be used to provide an antenna 14 can be readily affixed by adhesive or other means to the antenna support 12, in a manner allowing the antenna 14 to conform to the shape of the antenna support 12. Because an antenna 14 according to my invention is ground plane independent, it can be readily installed into a printed circuit board.

The ability to mount the antenna 14 in this manner allows the antenna 14 to be positioned in the apparatus 10 for optimal performance, and ease of installation. For an apparatus 10 in the form of a portable electronic device, such as a cellular phone, a PDA, or a portable computer, the antenna support 12 may be a surface of a housing of the electronic device, or a PCMCIA card installed in the apparatus 10. Where the support surface 12 is formed of a dielectric material, the elements 22, 24, 26 of the antenna 14 may be attached directly to the support surface 12, or even molded into the surface 12, with the support surface 12 thereby being both the support surface 12 and the antenna substrate 16.

In the antenna 14 shown in FIGS. 1 and 2, the driven element is a dipole 22 having a first and a second dipole element 28 extending colinearly in opposite directions from and perpendicular to the substrate axis 18. The dipole elements 28 have adjacent ends 30 spaced apart at equal distances on either side of the substrate axis 18. The reflector 24 is disposed on one side (to the left as depicted) of the dipole driven element 22 and the directors 26 are disposed on the other side (to the right as depicted) of the dipole driven element 22. The reflector 24 and directors 26 extend linearly across, are centered upon, and oriented perpendicular to the substrate axis 18.

As shown FIG. 1, in a preferred embodiment of the antenna 14, the length 32 of the reflector 24 is in the range of 1.08 to 1.3 times the length 34 spanned between of the outer ends of the first and second dipole elements 28, and the length 36 of the directors 26 is in the range of 0.8 to 0.95 times the length 34 spanned between of the outer ends of the first and second dipole elements 28. The dipole 22, directors 26 and reflector 24 each respectively define a centerline 38, 42, 40 thereof. Where the antenna 14 is adapted to broadcast a signal having a free space wavelength, the distance 44 between the center of the dipole 38 and the center of the reflector 40 is about 0.25 times free space wavelength. The distance 45 between the center of the dipole 22 and the center of the closest director 26, and the spacing 46 between adjacent directors 26, is about 0.325 times free-space wavelength.

The antenna 14 shown in FIGS. 1 and 2 has six directors 26. Such a configuration will provide a highly directional antenna 14 that is small in physical size. By reducing the number of directors 26, an antenna 14 having lower directivity may be provided. The physical size of the antenna 14 can generally be made smaller by using a larger number of directors 26. While it is certainly contemplated that my invention may be practiced with more than six directors 26, as a practical matter, the use of more than six directors will provide only nominally increased performance, with diminishing returns as additional directors 26 are added.

It is also noted that the performance of the antenna will be affected by the thickness and quality of the dielectric upon which the antenna elements 22, 24, 26 are mounted.

In one embodiment of an antenna 14 as described above, for an antenna of the type used in wireless communications and operating in the frequency range of 5.0 GHz to 6.0 GHz, the dipole 22 has an overall length 34 of about 0.944 inches, with the inner ends 30 spaced apart a distance 48 of about 0.078 inches. The reflector 26 has a length 32 of about 1.02 inches and has a center 40 spaced 44 about 0.51 inches from the dipole center 38. The six directors 26 have a length 36 of about 0.767 inches and have centers 42 spaced from one another at a distance 46 of about 0.614 inches, with the center 42 of the director 26 adjacent the dipole 22 being spaced 46 about 0.614 inches from the center 38 of the dipole 22. The dipole 22, directors 26 and reflector 24 have a width 50 extending parallel to the substrate axis 18 of about 0.047 inches.

It is further contemplated that the antenna 14 described in the preceding paragraph may be fabricated from an integrated blank of material having a dielectric substrate 16 of about 5 mils in thickness, and having a copper layer of several mils in thickness on either side of the substrate 16. A suitable dielectric would have a dielectric constant of about 2.2 and a loss tangent of about 0.0009. One material suitable for such an application is glass microfiber reinforced polytetraflouroethylene composite, such as a product sold under the name RT/duroid 5880, by Rogers Corporation, Microwave Products Division, of Chandler, Ariz., USA. The antenna 14 is formed by etching away the copper layer from one side of the blank, around the dipole 22, reflector 24 and director 26 to form the Yagi-Uda array as described above and in the drawings. The layer of copper on the other side of the substrate 16 may be totally etched away, if it is not needed for another purpose, such as providing connections to the dipole elements 28, as described below.

Connections (not shown) to the dipole 22 may be made in any appropriate manner known to those having skill in the art. For example, the inner ends 30 of the dipole elements 28 may form feed points to be contacted with a coaxial cable, or a microstrip line arranged perpendicular to the dipole 22. Alternatively, a portion of the copper material on the opposite side of the substrate may be left in place to form a coplanar wave guide lying parallel to and under the dipole 22, with appropriate pass through features connecting the coplanar wave guide to the inner ends 30 of the dipole elements 28.

While the embodiments of my invention disclosed herein are presently considered to be preferred, various changes and modifications can be made without departing from the spirit and scope of the invention. For example, the apparatus 10 may be a vehicle having a structure, such as a body panel or a roof, with the structure forming the antenna support 12. The flexible and flat physical structure of an antenna 14 according to my invention make it ideal for mounting on and conforming to an inside surface of a structure such as a body panel or the roof of the vehicle, for example, in a vehicle having a telematics unit communicating wirelessly through the antenna 14.

I also contemplate that it may be desirable to form a composite antenna from several antennas 14, as described herein, arranged with their respective axes 18 oriented perpendicularly or at an angle to one another, for providing an antenna having a desired directional gain pattern in the azimuth plane. Such a composite antenna could be utilized, for example, to cover 360 degrees of the azimuth plane, or sectors thereof. Each of the antennas 14 in the composite antenna may be fed simultaneously from a common source, or the feed to each antenna 14 in the composite antenna may be sequentially controlled using a switching device. The elements 22, 24, 26 of each antenna 14 in the composite antenna may be disposed on a common substrate 16.

The scope of the invention is indicated in the appended claims. I intend that all changes or modifications within the meaning and range of equivalents are embraced by the claims.

I claim:

1. An antenna, comprising:

a substrate of dielectric material; and a plurality of electrically conductive elements disposed on a surface of the substrate to form a Yagi-Uda dipole array, wherein the Yagi-Uda dipole array includes a driven element, a reflector, and at least one parasitic element, the reflector disposed on one side of a dipole, and the at least one parasitic element disposed on the other side of the dipole, and wherein the driven element is separate and distinct from the at least one parasitic element.

2. The antenna of claim 1, wherein electromagnetic energy is coupled from the driven element to one or more of the at least one parasitic element through space and by surface waves in the substrate.

3. The antenna of claim 2, wherein the driven element includes a first dipole element and a second dipole element extending colinearly in opposite directions from and perpendicular to a longitudinal axis of the substrate.

4. The antenna of claim 3, wherein the first dipole element and the second dipole element have adjacent ends spaced apart at equal distances on either side of the longitudinal axis of the substrate.

5. The antenna of claim 1, wherein the at least one parasitic element includes a reflector and at least one director.

6. The antenna of claim 5, wherein the reflector is disposed on a first side of the driven element; and wherein each director is disposed on a second side of the driven element.

7. The antenna of claim 5, wherein the reflector extends linearly across a longitudinal axis of the substrate.

8. The antenna of claim 5, wherein the reflector is centered upon a longitudinal axis of the substrate.

9. The antenna of claim 5, wherein the reflector is perpendicular to a longitudinal axis of the substrate.

10. The antenna of claim 5, wherein a first director of the at least one director extends linearly across a longitudinal axis of the substrate.

11. The antenna of claim 5, wherein a first director of the at least one director is centered upon a longitudinal axis of the substrate.

12. The antenna of claim 5, wherein a first director of the at least one director is perpendicular to a longitudinal axis of the substrate.

13. The antenna of claim 1, wherein the driven element and the at least one parasitic element facilitate a broadcast by the antenna of a signal having a free space wavelength.

14. An apparatus, comprising:

an antenna support; and an antenna mounted on the antenna support, the antenna including a substrate of dielectric material, and a plurality of electrically conductive elements disposed on a surface of the substrate to form a Yagi-Uda dipole array, wherein the Yagi-Uda dipole array includes a driven element, a reflector, and at least one parasitic element, the reflector disposed on one side of a dipole, and the at least one parasitic element disposed on the other side of the dipole, and wherein the driven element is separate and distinct from the at least one parasitic element.

15. The apparatus of claim 14, wherein electromagnetic energy is coupled from the driven element to one or more of the at least one parasitic element through space and by surface waves in the substrate.

16. The apparatus of claim 14, wherein the driven element includes a first dipole element and a second dipole element extending colinearly in opposite directions from and perpendicular to a longitudinal axis of the substrate.

17. The apparatus of claim 16, wherein the first dipole element and the second dipole element have adjacent ends spaced apart at equal distances on either side of the longitudinal axis of the substrate.

18. The apparatus of claim 14, wherein the at least one parasitic element includes a reflector and at least one director.

19. The apparatus of claim 18, wherein the reflector is disposed on a first side of the driven element; and wherein each director is disposed on a second side of the driven element.

20. The apparatus of claim 14, wherein the driven element and the at least one parasitic element facilitate a broadcast by the antenna of a signal having a free space wavelength.

21. The antenna of claim 1 wherein the driven element includes a dipole having a first and a second dipole element extending colinearly in opposite directions from and perpendicular to a substrate axis, the first and second dipole elements having adjacent ends spaced apart at equal distances on either side of the substrate axis.

22. The antenna of claim 1 wherein the reflector is separate and distinct from the driven element.

23. The apparatus of claim 14 wherein the driven element includes a dipole having a first and a second dipole element extending colinearly an opposite directions from and perpendicular to a substrate axis, the first and second dipole elements having adjacent ends spaced apart at equal distances on either side of the substrate axis.

24. The apparatus of claim 14 wherein the reflector is separate and distinct from the driven element.

* * * * *